United States Patent [19]

Cutri, deceased et al.

[11] 4,019,433

[45] Apr. 26, 1977

[54] PATTERN TRANSFER MACHINE

[76] Inventors: Frank J. Cutri, deceased, late of Brooklyn, N.Y.; by Louise Cutri, administratrix, 9214 Ridge Blvd., Brooklyn, N.Y. 11209

[22] Filed: Apr. 9, 1973

[21] Appl. No.: 348,959

[52] U.S. Cl. ..... 101/132.5; 101/228

[51] Int. Cl.[2] ..... B41L 7/08

[58] Field of Search ..... 101/228, 227, 219, 225, 101/132.5; 242/68, 68.3, 68.2, 68.4, 72, 55.2, 55.3; 226/190, 192, 196, 198; 193/35 B, 37

[56] References Cited

UNITED STATES PATENTS

| | | | |
|---|---|---|---|
| 2,243,604 | 5/1941 | Parkinson | 118/262 |
| 2,690,785 | 10/1954 | McWilliams | 156/84 |
| 2,859,691 | 11/1958 | Heller | 101/221 X |
| 3,049,078 | 8/1962 | Smith, Jr. | 101/228 |
| 3,063,407 | 11/1962 | Bergstein | 118/118 X |
| 3,085,617 | 4/1963 | Sorg | 101/228 |
| 3,139,963 | 7/1964 | Nadler et al. | 226/198 X |
| 3,177,804 | 4/1965 | Koch | 101/180 |
| 3,280,737 | 10/1966 | Huck | 101/228 X |
| 3,306,195 | 2/1967 | Cutri | 101/132.5 |
| 3,306,196 | 2/1967 | Cutri | 101/132.5 |
| 3,371,880 | 3/1968 | Clisham | 242/129.8 |

*Primary Examiner*—Edgar S. Burr
*Assistant Examiner*—Paul J. Hirsch
*Attorney, Agent, or Firm*—Morgan, Finnegan, Pine, Foley & Lee

[57] ABSTRACT

An improved pattern duplicating machine for transferring a printed pattern from a moving master sheet to a moving copy sheet by a pair of counter-rotating rolls mounted in yieldable pressure engagement with one another so as to form a nip therebetween, in which the master and copy sheets are guided into engagement on the surface of one of the rotating rolls prior to entry of the sheets into the nip formed between the pair of rolls. One of the rolls serves as a drive roll and engages the copy sheet over a major portion of its surface, the copy sheet being moistened with an even coating of activating fluid just prior to its engagement with the drive roll.

11 Claims, 7 Drawing Figures

INVENTOR.
FRANK J. CUTRI

BY

Morgan, Finnegan, Durham & Pine
ATTORNEYS

INVENTOR.
FRANK J. CUTRI
BY
Morgan, Finnegan, Durham & Pine
ATTORNEYS

INVENTOR.
FRANK J. CUTRI

BY

Morgan, Finnegan, Durham & Pine
ATTORNEYS

INVENTOR.
FRANK J. CUTRI

BY

Morgan, Finnegan, Durham & Pine
ATTORNEYS

PATTERN TRANSFER MACHINE

BACKGROUND OF THE INVENTION

This invention relates to a pattern duplicating machine and, more particularly, to improvements in pattern duplicating machines of the type in which a master sheet containing a pattern and a copy sheet wetted with an activating fluid are pressed into engagement between a pair of rolls.

This invention is an improvement of pattern transfer machines, or duplicating machines, of the type disclosed in my U.S. Pat. Nos. 3,306,194, 3,306,195 and 3,306,196. In general, these machines duplicate, as by printing, a pattern carried by a continuously moving master sheet that moves into registered face-to-face engagement with a copy sheet to receive the pattern. During operation of the machine, the active surface of the master sheet is activated with a fluid, such as alcohol, so that a wet inked pattern can be transferred to the copy sheet. In such machines, the activating fluid is carried by the copy sheet, which is moistened with the fluid at a location upstream of the contacting station. When the master sheet and copy sheet are pressed together, the pattern is activated and ink printing is transferred to the copy sheet.

In machines of this type, it has been found desirable to arrange the paths of the moving master and copy sheets in such a manner that they are maintained in contacting registration not only during transfer, but also prior to actual transfer so that the fluid on the wetted copy sheet begins activation of the pattern for a time before transfer, thus enhancing constrast and resolution of the transferred printed matter. It is also desirable to be able to rewind the master copy sheet for reloading or for rerunning the original master. To carry out this operation satisfactorily, the supply, take-up and guiding mechanisms for the master sheet must remain in proper registration with the transfer path. For perfect transfer, it is obviously also required that the master sheet and the copy sheet be perfectly relatively stationary during the transfer process.

In the pattern transfer machine disclosed in U.S. Pat. No. 3,306,196, superior guiding of the master sheet and efficient transfer of an inked pattern from the master sheet to the copy sheet is achieved by arranging the path of the master sheet so that opposite runs of the master sheet are in actual contact with each other over a portion of the travel between the supply rolls and the pair of rolls, and by running the master sheet in physical contact with the copy sheet for a short distance prior to entering the nip between the drive roll and the counter rotating pressure roll. Although this early exposure of the master pattern to the activating fluid improves the quality of the printing, additional guides and space are required and it is sometimes difficult to ensure that the unsupported contacting sheets move perfectly together during this time. In the present invention these difficulties are avoided.

Another experience with duplicating machines of this type is uneven wetting of the copy sheet, resulting in incomplete activation of the master sheet pattern and, consequently, poor contrast or blank areas of the printed matter. This occurs whenever any surface area of the copy sheet to receive printed matter is not sufficiently wetted with the transfer fluid or if incorrect wetting pressure is applied. The machine of the present invention is effective in virtually eliminating uneven application of the fluid to the copy sheet.

SUMMARY OF THE INVENTION

Briefly, the improved duplicator according to the invention guides the master sheet and the copy sheet into face-to-face contact and engagement, preferably under pressure, with the surface of one roll of the rotating pair of rolls applying pressure to the two sheets to effect the printing transfer. In the preferred embodiment, the copy sheet engages the surface of the rotating drive roll over a major portion of its circumferential surface, coming into contact with the surface ahead of a plane through the rotational axes of both rolls of the pair.

Further improvements according to the invention include the use of an equilizing surface downstream of a wetting means for the copy sheet in order to facilitate an even application of wetting fluid to the one side of the copy sheet. In the preferred form of the invention, this surface also is immediately upstream (ahead) of the point of engagement of copy sheet with the pull roll and applies a slight pressure to the wetted surface.

Yet another feature of the invention is a tension sensor responsive to the tension of the master sheet for controlling the means driving the pair of rolls, and operative automatically to stop the machine upon loss of tension of the master sheet. In conjunction with the tension sensor, the master sheet supply roll may be equipped with means for applying torsional resistance to the roll to prevent its unwinding too rapidly, thus ensuring proper feed of the master.

BRIEF DESCRIPTION OF THE DRAWINGS

The invention may be better understood from the accompanying drawings, in which.

DESCRIPTION OF THE EMBODIMENT

It will be understood that, as used throughout this specification and in the accompanying claims, as is customary in the art, the terms "upstream" and "downstream" refer to locations with respect to the moving copy sheet or master sheet, as the case may be, and thus conveniently serve to locate the relative positions of the elements of the apparatus described or the sequence of operations performed.

Figure 1:
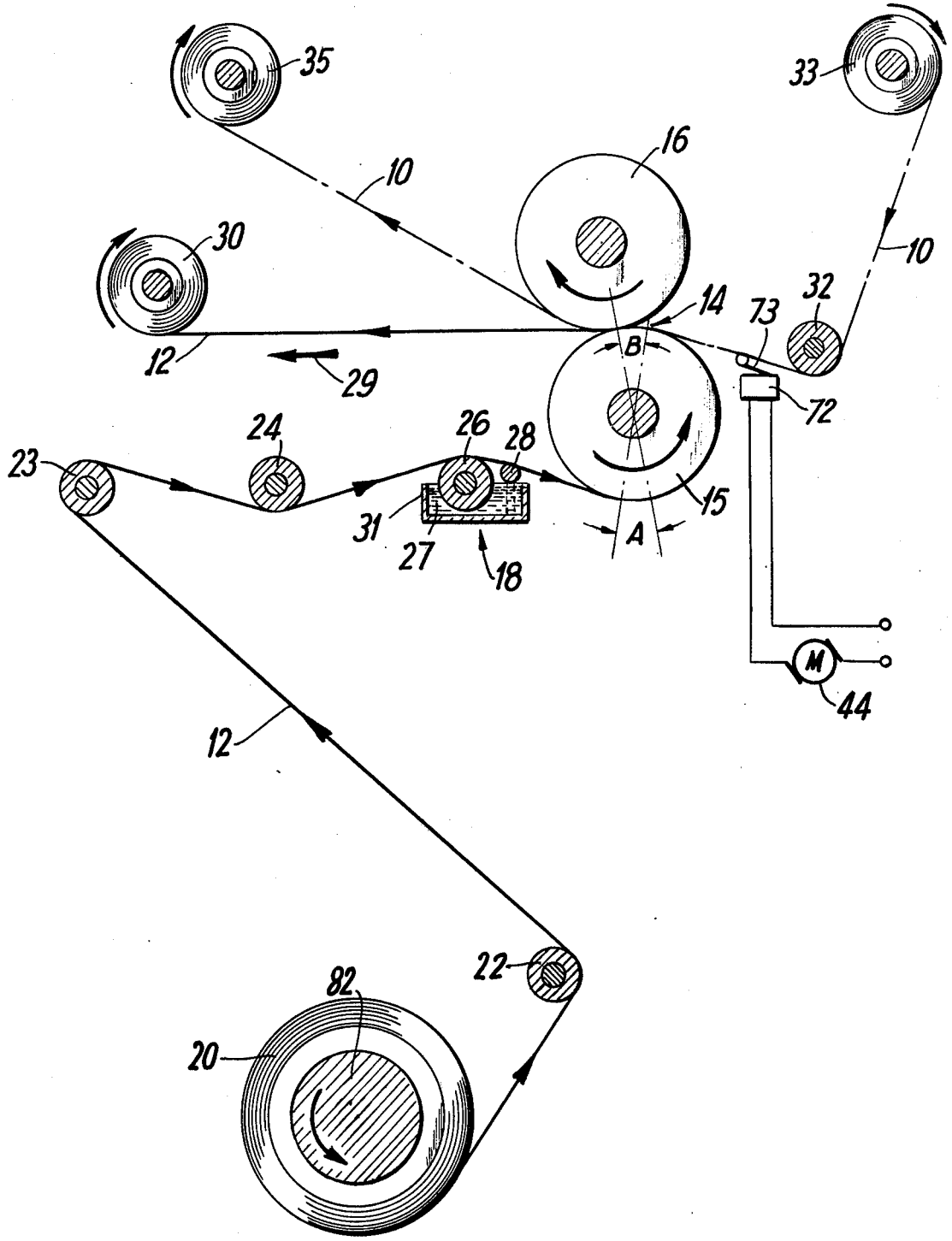
FIG. 1 is a schematic side elevation view of a duplicating machine according to the invention, depicting the travel paths of the master and copy sheets and the primary guides and rolls.
Figure 2:
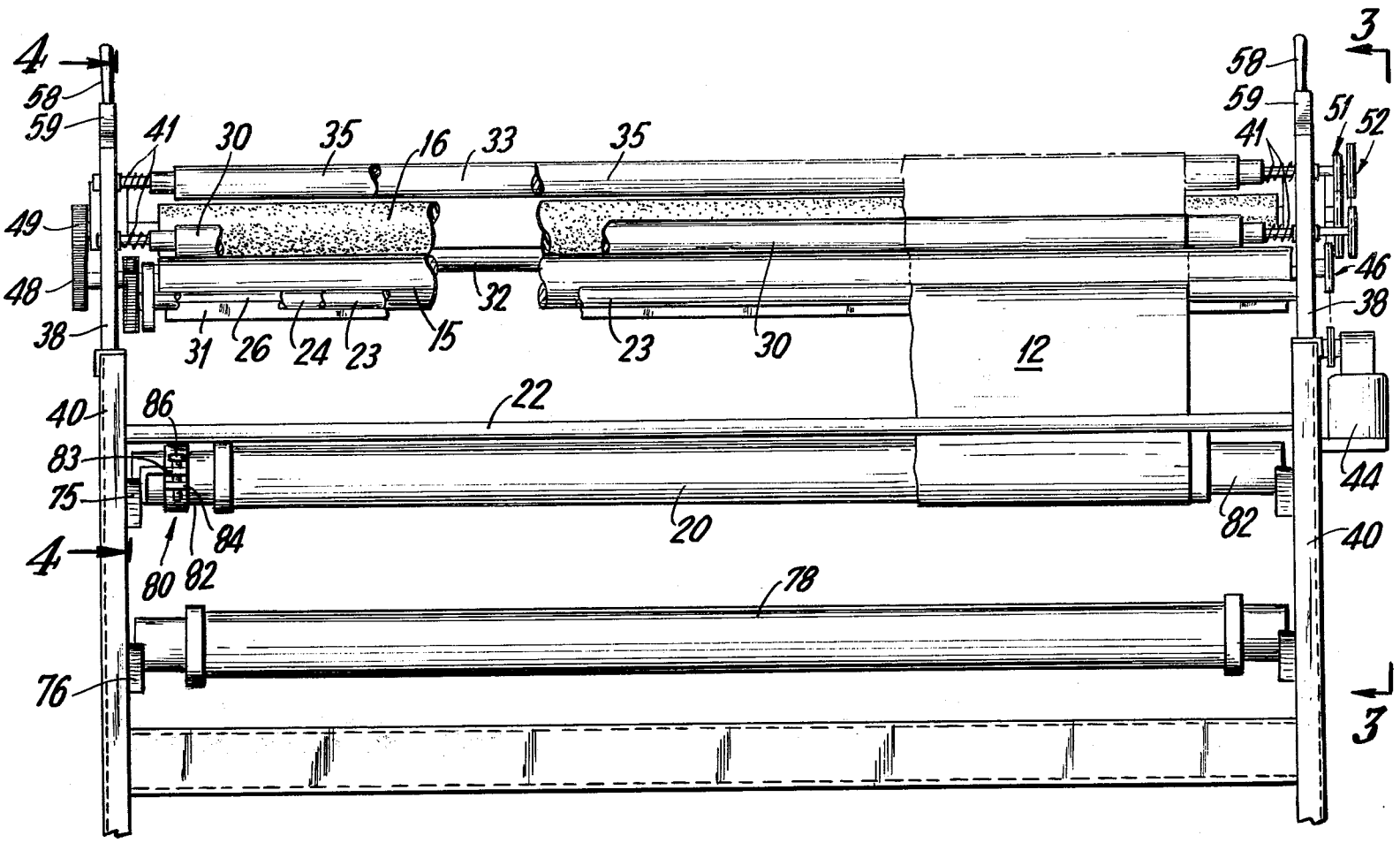
FIG. 2 is a front elevation view of the duplcating machine.

The operation and layout of the principal components of the machine, in accordance with the invention, are best understood from FIG. 1, illustrating the paths travelled by the master sheet 10, containing the pattern to be transferred, and by the copy sheet 12 upon which the pattern is printed. Printing of the master pattern, i.e., the inked pattern, is carried out at the nip 14 between a pair of rolls 15, 16. As will be fully explained shortly, the copy sheet 12 is wetted with an agent which activates the pattern on the master sheet when the master and copy sheet come into contact on the cylindrical surface of the roll 15. This wetting, or moistening, operation is carried out at the moistening station 18 just ahead (upstream) of the drive, or pull roll 15. Each of the mating rolls 15, 16 is positively driven by drive means through a transmission system, as will be described in more detail. The counter-rotating pressure roll 16, moreover, is resiliently pressed against the drive roll 15 under yieldable spring pressure.

The copy sheet 12 is contained on a supply roll 20 at the lower portion of the apparatus and is guided over a small idler roll 22 reversely and upwardly to separate idler rolls 23, 24, generally linearly spaced from the moistening means 18. The copy sheet passes alternately over and under the idler roll surfaces to the upper surface of the moistening roll 26, which is partially immersed in the bath of activating fluid 27 within the trough 31. All of the idler rolls, the supply roll 20 and moistening roll 26 are generally parallel to one another, as are the other rotational guides and rolls of the apparatus, and are journaled in the side members of the machine.

At the moistening station 18, the fluid coating the roll 26 wets the contacting surface of the copy paper, after which the paper comes into contact with the upper surface of a fixed equalizing rod 28. As is well known by those skilled in the art, the master pattern may comprise a generally dry inked area that becomes sufficiently wet for transferring an inked impression when moistened with a solvent such as alcohol.

It can be seen that the upper surface of the rod 28 projects into the path of the tensioned web of copy paper between the moistening roll 26 and the pull roll 15, thereby applying a slight upward pressure to the wetted surface and also guiding the copy paper to the roll 15. The rod serves to spread any excess collection of liquid to other parts of the copy paper and also, to a certain extent, to press moisture into the copy paper fibers. If the equalizing rod 28 is rotatable, it, too, may independently apply a certain amount of additional liquid to the copy paper. As the paper passes over the equalizing roll, a film or wave of liquid builds up in front of the line of contact with the rod surface, tending to force liquid into puckered areas of the copy sheet that may be present due to excess humidity of the environment.

In the known machines, the amount of liquid applied to a given area of the sheet varies directly with the web velocity. Attempts to increase the speed of the operation simply resulted in poor copies because, as later discovered, excess moisture did not have sufficient time to evaporate prior to the contact printing. It has been found that the removal of excess liquid and the thorough moistening of the copy sheet by the action of the equilizing rod 28 enables the velocity of the webs through the machine to be increased by as much as fifty percent.

As is apparent from FIG. 1, the copy paper contacts the surface of the pull roll 15 in advance of a plane that includes the axes of both rolls 15, 16. It thus wraps around a major portion of the circumferential surface, departing from the roll 15 just behind the nip 14, from where it travels in a final run 29 to the copy paper take-up roll 30. In this connection, it will be noted that the downstream run 29 of the copy paper 12 is generally parallel to the line of separation of the idler rolls 23, 24 and the wetting roll 26. This arrangement not only conserves the space within the duplicating machine itself, but enables the copy paper to engage a major portion of the drive roll 15. The polar angle A of the roll 15 defined between the plane connecting the axes of rotation of the rolls 15, 16 and the line of contact of the copy paper with the roll surface may be made larger or smaller, if desired. An angle of about 20° has been found to provide excellent results. This is the same angle, as shown, between the plane and the line of contact of the master sheet 10 with the roll 15 just in advance of the roll nip. This angle B is thus also about 20° and results from the horizontally offset relationship of the rolls 15, 16 and the lower position of the guiding idler roll 32, which accepts the master sheet from the master sheet supply roll 33, supported above the idler roll 32 and the counter pressure roll 16. Passing through the nip 14 of the rolls, the master sheet flows directly to a master sheet take-up, or rewind, roll 35, located generally above the copy sheet take-up roll 30.

Due to the arrangement of elements shown in FIG. 1, the master sheet 10 is guided to come into contact with the copy sheet 12 on the cylindrical surface of the roll 15 prior to entry of the two sheets into the nip 14 of the rolls, and a longer exposure time of the inked pattern on the master sheet to the moistened copy is possible. Moreover, this face-to-face mating contact of the two sheets occurs over the solid outer surface of the roll 15, and is preferably under a slight pressure, thereby tending to release moisture to the pattern prior to its entry to nip 14. This feature eliminates the requirement for additional guide rolls and other mechanisms for contacting the two sheets where there may be insufficient support or where sufficient space is unavailable. In the arrangement disclosed in U.S. Pat. No. 3,306,196, additional idler rolls are required to achieve a similar result and, even then, the two sheets travel to the nip of the rolls without firm support of either surface, with the attendant possibility of a degree of premature printing that is not in registration with the final printing. By raising and lowering the master sheet guiding idler roll 32, advance contact of the master sheet and the copy sheet and the amount of pressure therebetween can be adjusted.

The relationship among the various rolls of the apparatus and the manner in which they are supported are illustrated in detail in FIGS. 2–5. The rolls are journalled in the side frame members 38 of the apparatus, which, in turn, are carried by a suitable stand or leg assembly 40. The copy sheet rewind roll 30 and the master sheet rewind roll 35, it will be noted, are resiliently biased centrally between the side member 38 by helical springs 41 surrounding the shafts upon which the rolls rotate about a fixed axis of rotation. These springs supply an axial biasing force at each end of the roll which, accordingly, tends to keep the roll perfectly centered, but nevertheless free to make minor horizontal adjustments responsive to lateral forces as the copy sheet and master sheet are wound and unwound from these two rolls. These minor horizontal adjustments are insufficient to affect rotation of rolls 30, 35 through the gear arrangement more fully described hereinafter.

In order to maintain registration between the master sheet and the copy paper upon a rerun of the master, it is important that both the master sheet and copy paper rolls be mounted in the true center of the machine — i.e., equidistant from the side frames 38. Thus, when it is desired to rerun the master sheet, the master sheet rewind roll 35 is removed from the machine and reversed by flipping the roll over end-to-end and inserting it in the position of the master sheet supply roll 33. It will be apparent that registration between the master sheet and the copy paper will be lost when the master sheet roll is reversed unless the master sheet and copy paper supply rolls 20 and 33, and the pull roll 15 and counterpressure roll 16, are each located at a nominal position in the true center of the machine. Such centering is achieved by the resilient means at the opposite ends of the rewind rolls 30, 35 and may also be used in the supply rolls 20, 33.

All of the rolls are energized by a motor 44 (FIGS. 2 and 3) driving the main roll 15 through a sprocket gear and chain drive designated generally as 46. The pull roll 15, in turn, drives the pressure roll 16 through a set of meshed gears 48, 49 at the other side of the machine (see FIGS. 2, 4 and 5). Rotation of the pressure roll 16 brings about rotation of both the take-up rolls 30, 35 through suitable drive connections, such as further sprocket and chain drives 51 and 52 (FIG. 5).

Figure 6:
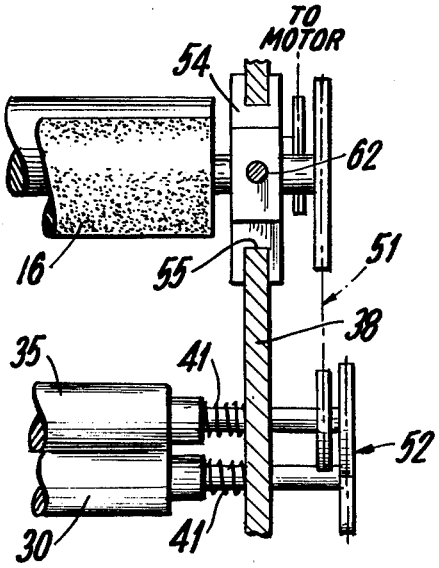
FIG. 6 is a cross-section view taken along 6—6 of FIG. 3.

It is understood that the pressure roll 16 will usually be constructed of or coated with a resilient material, such as rubber, plastic or fiber and, further, that it is resiliently downwardly biased into engagement with the surface of the pull roll. To that end, the guide block 54 journals the shaft of the pressure roll and is free to move vertically guided by the edge 55 of the vertical opening in the frame member 38. This relationship may be seen clearly in FIG. 6. Although the roll 16 moves vertically, the gears 48, 49 remain meshed.

A pair of levers 58 at the top of the apparatus each is affixed to and operates a cam 59 engaging a top cross member 60 to raise or lower a respective rod 62 pivotally connected to the cam and extending upwardly from the guide block 54. Movement of the lever from a vertical position to a horizontal position raises the pressure roll 16 away from the surface of the drive roll 15. This arrangement is substantially the same as that used in the duplicating machines disclosed in the patents mentioned above.

During threading and reloading operations, the handle 58 is generally moved downwardly to the horizontal position so that the master and copy sheets can be inserted between the rolls 15 and 16.

Figure 7:
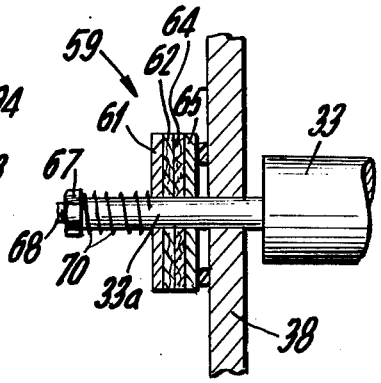
FIG. 7 is a cross-section view of a portion of the apparatus taken along 7—7 of FIG. 3.

In accordance with the invention, the master sheet is maintained under optimum tension during its movement between the master sheet supply roll 33 and the roll nip 14. This is accomplished by a slip clutch assembly 59, shown in FIG. 7, for inhibiting free rotational movement of the master sheet supply roll 33. Referring to the cross-sectional representation of FIG. 7, it can be observed that the supply roll shaft 33*a* extends through the side frame member 38 and carried, at its outer end, a clutch constituted of a circular steel plate 61 faced with a fibrous friction plate 62 in rotational slipping engagement with a similar plate 64 mounted to a plate 65 that is secured to the side frame member 38.

At the outer end of the shaft 33*a*, threads 68 carry an adjusting nut 67 for regulating the compression of the helical spring 70. When the nut 67 is screwed toward or away from the side frame member, the pressure exerted by the spring 70 on the disc clutch assembly is increased, or decreased, respectively. Upon rotation of the roll 33, frictional slipping occurs between the plates 62, 64 so that a torque resisting rotation is applied to the shaft 33*a*, opposed by the tension force of the unwinding master web 10.

Owing to the clutch assembly 59, the master sheet 10 is maintained under proper tension, preventing slack in the master sheet and ensuring smooth even downward pressure free of web creases and distortion. Such action also precludes free-wheeling unwinding of the master sheet upon stopping of the duplicating machine. In this regard, a switch 72 (FIG. 1) actuatable by a lever 73 resiliently biased against the master sheet is wired in series circuit with the exciting source of power and the drive motor. If the master sheet ruptures, or upon relaxation of the tension on the master sheet, the normally closed switch 72 opens the power circuit to the motor, thus halting operation of the duplicator. The switch 72 also functions to stop the duplicator immediately at conclusion of the unwinding of the master sheet of the roll 33. Thus, the machine immediately stops when the master web 10 leaves the roll 33, and the master sheet need not be rethreaded through the machine, but may be simply rewound, if desired, by reversing the direction of the drive through suitable means (not shown), as by reversing the direction of rotation of the motor.

A similar or identical switch arrangement (not shown), in series with the switch 72, can be used to sense upward motion of the web representing excess tension. In such case, the additional switch may interrupt operation even though the switch 72 is closed, as will be understood by those skilled in the art. Proper adjustment of two switches establishes a zone of permissible tension, and more refined control can be obtained by electromechanical control of the clutch 59 in response to finite tension variations.

Figure 3:
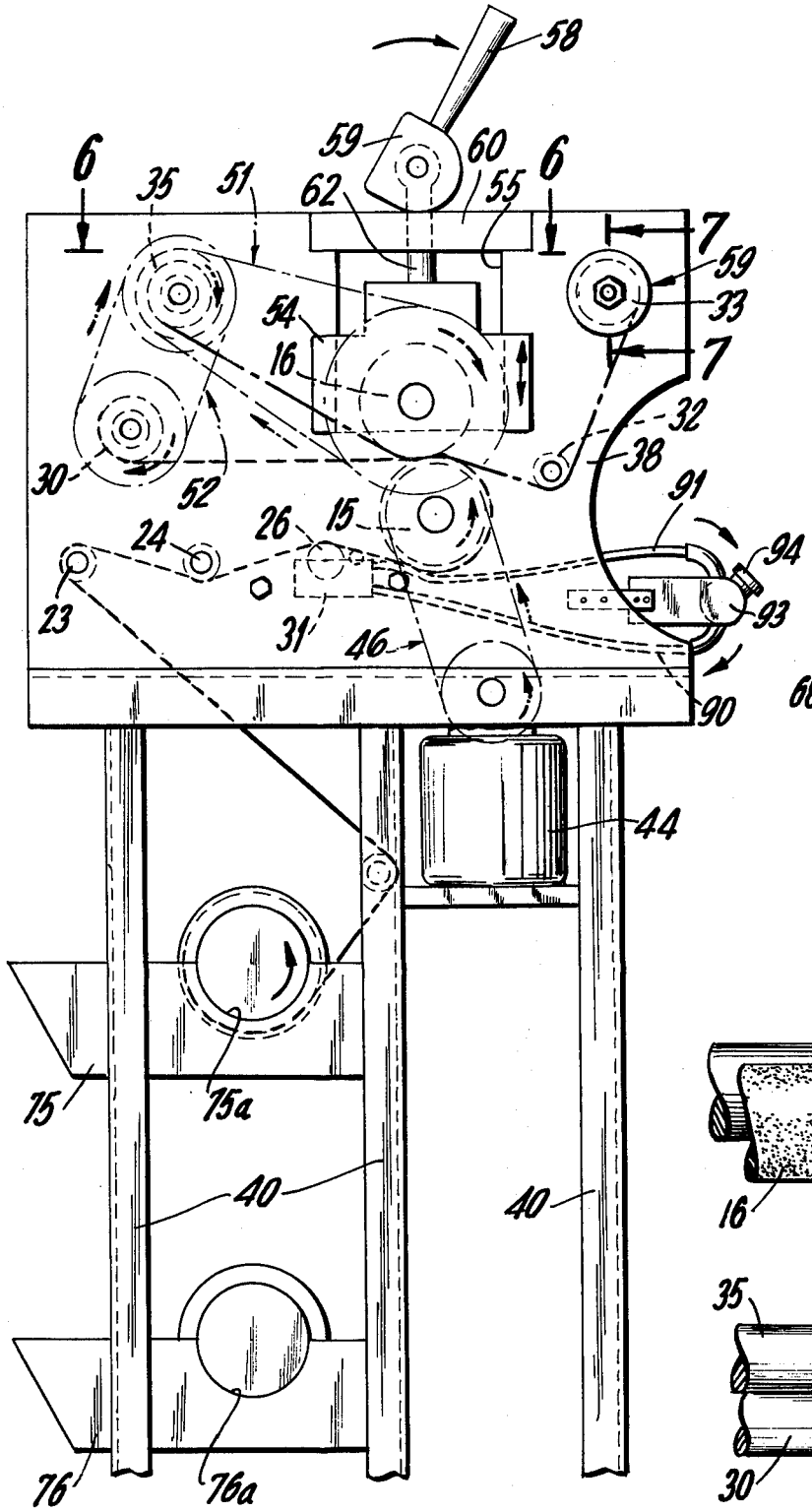
FIG. 3 is right-side elevation view of the machine taken along 3—3 of FIG. 2.

As can be seen from FIG. 3, the copy sheet supply roll 20 may be supported at selected distance from the idler roll 23. In the duplicating machine illustrated, a pair of supply roll brackets 75, 76 is located between the support legs 40 of the machine. To change the copy sheet supply roll, or to replace a spent roll, the existing roll of copy sheet paper is simply lifted out and replaced by a new roll, with the roll shaft resting in one of the concave notches 75*a*, 76*a*. Optionally, the device may include an extra supply roll 78 loaded with extra copy paper of the same or different width as that on roll 20.

Figure 4:
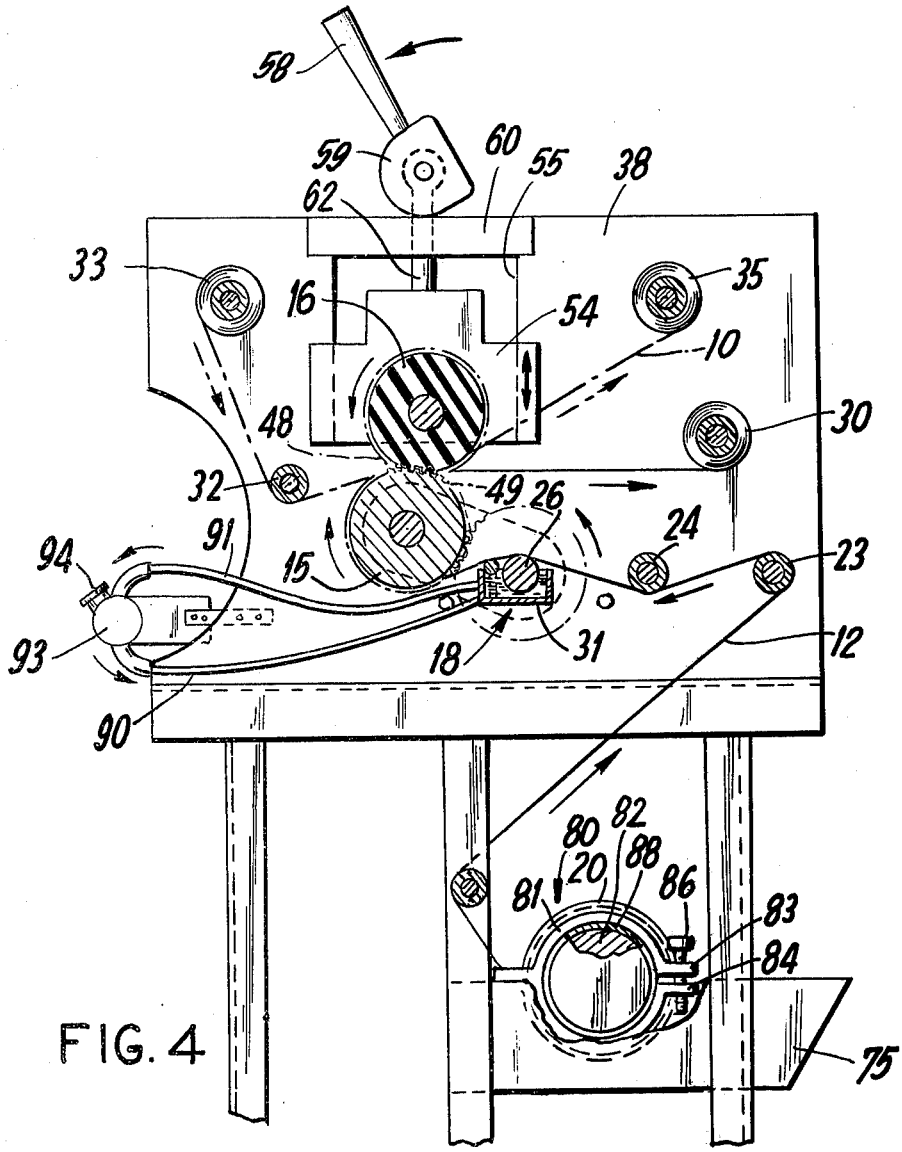
FIG. 4 is a left-side elevation view of the apparatus in cross-section, taken along 4—4 of FIG. 2.
Figure 5:
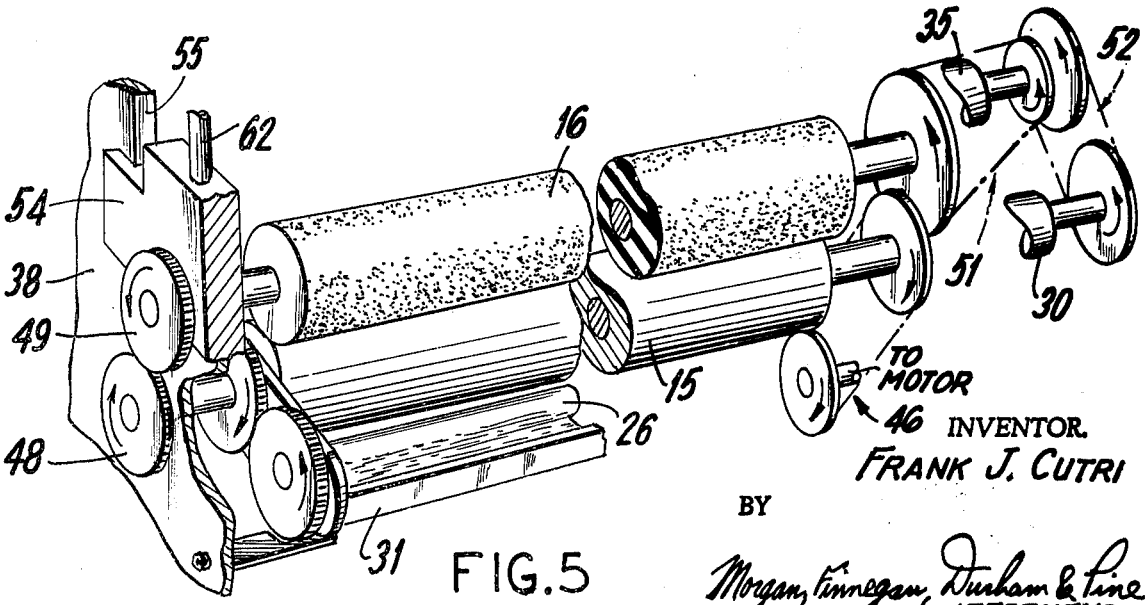
FIG. 5 is a cut-away, partial perspective view of the principal rolls of the machine, illustrating schematically the power transmission means of the machine.

Referring to FIG. 4, the supply roll 20 has associated therewith a special brake assembly 80 similar to the assembly disclosed in my previous U.S. Pat. No. 3,306,196, which includes a split ring 81 surrounding the shaft 82 of the supply roll and having a pair of jaw extensions 83, 84, which may be adjustably closed and opened by operation of the screw 86. Intermediate the shaft 82 and the split ring is a cylindrical brake lining 88, which is compressed or expanded by operation of the screw 86. Thus, the tension on the copy sheet 12 between the supply roll 20 and the pull roll 15 may be selected by simple adjustment. It will be understood that a similar brake arrangement may be provided at the opposite end of the supply roll shaft.

FIGS. 3 and 4 also illustrate the manner in which the transfer agent 27 contained in the reservoir tank 31 is circulated. Leading into the tank are flexible conduits 90 and 91 connected to a pump or chamber 93 at the rear of the machine which includes a fill pipe 94. Although a mechanical pump is shown, it should be understood that a simple provision fior filling and draining the tank 30 may be sufficient, depending on the nature of the activating agent and the routing of the lines 90, 91. With a mechanical pump such as the unit 93 in the system, however, the fluid may be circulated, filtered or otherwise cleansed in a continuous manner.

In summary, the improved duplicating machine of this invention may be constructed to be more compact that prior machines of the type and, moreover, provides efficient transfer of the printed material with superior resolution. Because the wetted copy paper and the active pattern on the master sheet are brought firmly into contact prior to subjecting the two sheets to the action of the pressure and drive rolls, the efficiency and resolution of transfer are improved. Also, the action of the equalizing rod at the fluid bath serves to ensure complete moistening of the copy sheet, permitting significantly higher operating speeds. Further, because of the unique arrangement of the guiding mechanism, a greater portion of the surface of the pull roll is utilized in drawing the copy sheet into the roll nip, thus avoiding relative slippage between the copy sheet and the master sheet, which would otherwise result in a smeared printed copy. In that connection, the use of the clutch and brake assemblies for controlling tension on the two moving webs cooperates with the pair of rolls to maintain proper and constant tension compatible with the pullng force of the rolls.

Although the invention has been described with reference to a specific, preferred embodiment, certain modifications and variations, both in form and detail, will occur to those skilled in the art. For example, the invention should not be restricted to a particular type of master sheet or to the type of material used thereon. Also, rearrangement of certain of the rolls and guides may be made to accommodate various designs, it being required only that the desired improved operations described can be obtained. Accordingly, all such modifications and variations are intended to be included within the scope of the appended claims.

What is claimed is:

1. A duplicating machine for transferring a pattern from a moving master sheet to a moving copy sheet, comprising:

a pair of parallel upper and lower engaged rolls forming therebetween a nip for receiving said master copy sheets in face-to-face contact, motor means rotatably driving at least one of said pair of engaged rolls, and means mounting at least one of said pair of engaged rolls in yieldable pressure contact with the other roll of said pair of rolls, whereby said engaged rolls rotate in counter-rotating directions to thereby feed said master and copy sheets therebetween in face-to-face pressure contact;

a master sheet supply roll and a master sheet rewind roll mounted parallel to and on opposite sides of said pair of engaged rolls at a point above said nip, whereby said master sheet passes from its supply roll through said nip to its rewind roll in a generally V-shaped path;

fluid wetting roll means mounted parallel and in closely spaced relation to the lower roll of said pair of engaged rolls at a point adjacent the lower portion thereof and on the same side thereof as said master sheet rewind roll;

a copy sheet supply roll mounted parallel to said pair of engaged rolls at a point below said nip and also below said fluid wetting roll means;

copy sheet idler roll means located in spaced relationship between said copy sheet supply roll and said fluid wetting roll means and positioned so as to guide said copy sheet in a generally horizontal line over said fluid wetting roll means in pressure contact therewith and thence into contact with the circumferential surface of said lower roll of said pair of engaged rolls, said fluid wetting roll mens engaging a first surface of said copy sheet to locate said copy sheet for subsequent engagement with said lower roll of said pair of engaged rolls and for applying fluid reactive with a pattern carried by said master sheet for moistening said first surface thereof, said copy sheet thereafter engaging said lower roll of said pair of engaged rolls on a second surface thereof which is opposite said first surface, said copy sheet engaging said lower roll of said pair of engaged rolls at a point at least 180° upstream of said nip formed between said lower roll and said upper roll engaged therewith; and a copy sheet rewind roll mounted parallel to and spaced from said pair of engaged rolls on the same side thereof as the master sheet rewind roll and defining therewith a return run of said copy sheet from said nip formed between said pair of engaged rolls with the printed pattern from said master sheet imprinted thereon, said return run of said copy sheet moving in a direction generally parallel to said generally horizontal line along which said copy sheet travels over said fluid wetting roll means.

2. A duplicating machine as claimed in claim 1, including means for applying a variable torsional force to each of said master and copy sheet supply rolls to resist rotation thereof, thereby establishing desired tension in each of said master and copy sheets along their respective directions of movement.

3. A duplicating machine as claimed in claim 1, wherein:

the rotational axes of said pair of engaged rolls are offset and the lower roll thereof is positioned so that said copy sheet engages the circumferential surface of said lower roll at a point upstream of a plane containing said rotational axes of said pair of rolls; and means for guiding said master sheet into substantially stationary face-to-face pressure contact relative to said copy sheet against the circumferential surface of said lower roll of said pair of engaged rolls prior to passage of said master and copy sheets into and through said nip formed between said pair of engaged rolls, said master sheet engaging said copy sheet on the surface of said lower roll of said pair of engaged rolls at a point diametrically opposite the point at which said copy sheet engages the surface of said lower roll, whereby said pattern carried by said master sheet is exposed to said reactive fluid applied to said copy sheet in advance of the imprinting of said pattern from said master sheet onto said copy sheet as said master and copy sheets pass through said nip between said pair of engaged rolls in face-to-face pressure contact.

4. A duplicating machine as claimed in claim 1, wherein said fluid wetting roll means includes:

a moistening roll partially immersed in a reservoir of the pattern reactive fluid and rotatably mounted so as to apply a coating of said fluid to said first surface of said copy sheet; and a rod member mounted parallel to and intermediate said moistening roll and said lower roll of said pair of engaged rolls at a point so as to be in the path of movement of said copy sheet so as to contact substantially the entire first surface thereof coated with said reactive fluid with sufficient upward pressure to uniformly distribute excess fluid over the entire surface area of said first surface of said copy sheet.

5. A duplicating machine as claimed in claim 1, wherein said copy sheet idler roll includes:

first and second spaced idler rolls positioned immediately upstream of said fluid wetting roll means and positioned in a substantially straight horizontal line with said fluid wetting roll means, said first and second idler rolls respectively engaging opposite surfaces of said copy sheet.

6. A duplicating machine as claimed in claim 1, wherein each of said master and copy sheet rewind rolls includes axially-inwardly biased resilient means at each end thereof to thereby maintain each of said master and copy sheet rewind rolls in a central position relative to the respective paths of movement of said master and copy sheets.

7. A duplicating machine as claimed in claim 2, further including means responsive to the tension of said master sheet for controlling said motor means rotatably driving said at least one roll of said pair of engaged rolls comprising:

a sensor member engaging said master sheet and being resiliently biased thereagainst; and electrical switch means coupled to said sensor member for interrupting operation of said motor means upon movement of said sensor member due to a deviation in the tension of said master sheet from a predetermined value.

8. A duplicating machine as claimed in claim 3, wherein the angle between a line joining the diametrically opposite points of engagement of said master and copy sheets with the surface of said lower roll of said pair of engaged rolls and said plane containing the rotational axes of said pair of engaged rolls is approximately 20°.

9. A duplicating machine as claimed in claim 3, wherein said master sheet guide means comprises an idler roll positioned parallel to and generally below said nip between said pair of engaged rolls on the same side thereof as the master sheet supply roll at a point relatively closely adjacent to said lower roll of said pair of engaged rolls, so as to guide said master sheet into said nip along a plane generally parallel to the direction of movement of said copy sheet immediately prior to face-to-face pressure engagement of said master sheet with said copy sheet against the surface of said lower roll of said pair of engaged rolls.

10. A duplicating machine as claimed in claim 4, wherein said rod member is rotatable.

11. A duplicating machine as claimed in claim 5, wherein said copy sheet idler roll means includes a third idler roll positioned below said first and second idler rolls and relatively closely spaced from said copy sheet supply roll at a point so as to guide said copy sheet in a path reversely upwardly toward said first and second idler rolls.

* * * * *

UNITED STATES PATENT AND TRADEMARK OFFICE

CERTIFICATE OF CORRECTION

PATENT NO. : 4,019,433

DATED : April 26, 1977

INVENTOR(S) : Frank J. Cutri, deceased; by Louise Cutri, Administratrix

It is certified that error appears in the above-identified patent and that said Letters Patent are hereby corrected as shown below:

Column 1, line 34, change "constrast" to -- contrast --. Column 2, line 17, change "equilizing" to -- equalizing --; line 54-55, cancel "THE" and substitute therefor -- PREFERRED --. Column 3, line 60, change "equilizing" to -- equalizing --. Column 4, line 56, after "side" insert -- frame --. Column 6, line 38, change "distance" to -- distances --. Column 7, line 9, change "that" to -- than -- and change "the" to -- this --; line 28, change "pullng" to -- pulling --. Column 8, line 12, change "mens" to -- means --. Column 9, line 20, after "roll" insert -- means --.

Signed and Sealed this twenty-sixth Day of July 1977

[SEAL]

Attest:

RUTH C. MASON
*Attesting Officer*

C. MARSHALL DANN
*Commissioner of Patents and Trademarks*